US008550300B2

(12) United States Patent
Lee et al.

(10) Patent No.: US 8,550,300 B2
(45) Date of Patent: Oct. 8, 2013

(54) STORAGE CONTAINER AND USE OF THE STORAGE CONTAINER

(75) Inventors: Hyeck-Hee Lee, St. Ingbert (DE); Ute Steinfeld, St. Ingbert (DE); Jungtae Kim, Saarbrucken (DE); Holger Krause, Neunkirchen (DE)

(73) Assignees: KIST—Europe Forschungsgesellschaft mbH (DE); F. Holzer GmbH (DE)

( * ) Notice: Subject to any disclaimer, the term of this patent is extended or adjusted under 35 U.S.C. 154(b) by 515 days.

(21) Appl. No.: 12/778,249

(22) Filed: May 12, 2010

(65) Prior Publication Data

US 2010/0287891 A1 Nov. 18, 2010

(30) Foreign Application Priority Data

May 15, 2009 (DE) ..... 10 2009 021 501
Oct. 27, 2009 (EP) ..... 09 013 533

(51) Int. Cl.
*B05B 11/04* (2006.01)
*B65D 83/00* (2006.01)

(52) U.S. Cl.
USPC ..... 222/95; 222/105; 222/386.5

(58) Field of Classification Search
USPC ..... 53/470; 222/92, 95, 96, 105, 214, 385, 222/386.5, 387, 389, 94, 326, 327; 239/327, 328
See application file for complete search history.

(56) References Cited

U.S. PATENT DOCUMENTS

| | | | | |
|---|---|---|---|---|
| 3,335,913 | A * | 8/1967 | Bouet | 222/95 |
| 3,477,195 | A * | 11/1969 | Chambers | 53/470 |
| 4,136,802 | A * | 1/1979 | Mascia et al. | 222/95 |
| 4,147,282 | A | 4/1979 | Levy | |
| 5,111,971 | A | 5/1992 | Winer | |
| 6,223,933 | B1 | 5/2001 | Hochrainer et al. | |
| 6,250,505 | B1 * | 6/2001 | Petit | 222/95 |
| 6,332,482 | B1 | 12/2001 | Runge et al. | |
| 6,648,244 | B2 * | 11/2003 | Yu | 222/95 |
| 6,705,493 | B1 | 3/2004 | Mijers et al. | |
| 6,789,702 | B2 * | 9/2004 | O'Connor et al. | 222/96 |
| 2002/0020715 | A1 | 2/2002 | Gueret | |
| 2005/0145722 | A1 | 7/2005 | Wang | |
| 2007/0151987 | A1 | 7/2007 | Arghyris et al. | |
| 2009/0014471 | A1 * | 1/2009 | Lin | 222/96 |
| 2010/0108716 | A1 * | 5/2010 | Bilko | 222/95 |

FOREIGN PATENT DOCUMENTS

| | | | |
|---|---|---|---|
| DE | 28 22 115 | A1 | 12/1978 |
| DE | 9211396 | U1 * | 2/1993 |
| DE | 19742890 | A1 * | 4/1999 |
| DE | 198 51 404 | A1 | 5/2000 |
| DE | 199 38 798 | A1 | 3/2001 |
| EP | 521278 | A1 * | 1/1993 |
| FR | 2685224 | A1 * | 6/1993 |
| JP | 04102567 | A * | 4/1992 |
| WO | WO-2006/043295 | A1 | 4/2006 |
| WO | WO 2008110600 | A1 * | 9/2008 |
| WO | WO 2009109370 | A1 * | 9/2009 |

* cited by examiner

*Primary Examiner* — Stephen F Gerrity
(74) *Attorney, Agent, or Firm* — Schwegman Lundberg & Woessner, P.A.

(57) ABSTRACT

An embodiment of the present invention relates to a storage container for liquids or for viscous or atomizable products, which can be connected to a metering device, the storage container having a cylindrical configuration and a base with a pressure equalization device and also an oppositely situated open side, the open side including a connection region, and in that an inner bag which is collapsible by suction force is disposed in the storage container.

20 Claims, 11 Drawing Sheets

STORAGE CONTAINER AND USE OF THE STORAGE CONTAINER

CLAIM OF PRIORITY

Figure 1A:
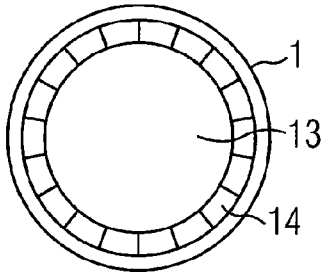

The present patent application claims the priority benefit of the filing date of German Patent Application No. 10 2009 021 501.8, filed May 15, 2009, and the priority benefit of the filing date of European Application No. EP 09 013 533.6, filed Oct. 27, 2009, the entire contents of each of which are incorporated herein by reference in their entirety.

By way of example, but not by way of limitation, the invention relates to a storage container for liquid, viscous or atomisable products and also the use of the storage container.

Spraying devices are already known for example in the sphere of provisions or foodstuffs and also for medical applications. DE 199 38 798 A1 describes a dispenser with a metering device. The storage container of this spraying device is thereby formed by a cylindrical container in which a flying piston which controls the removal of liquid is disposed.

A disadvantage of such a flying piston is the possibility of jamming in the storage container and also leakage and, associated therewith, the impossibility of complete emptying of the storage vessels and also possibly loss of liquid from the storage container because of the already mentioned leaks.

Starting herefrom, an object of the present invention can be to provide a storage container which has the capacity to be emptied completely and also complete impermeability and also to indicate use thereof.

According to an embodiment of the invention, a storage container for liquids or for viscous or atomisable products which can be connected to a metering device is provided, the storage container having a cylindrical configuration and having a base with a pressure equalisation device and also an oppositely situated open side, the open side including a connection region, and in that an inner bag which is collapsible by suction force is disposed in the storage container.

It can be ensured by the collapsible inner bag that the liquid or the viscous or atomizable products can be removed completely from the storage container. Furthermore, this inner bag represents a further barrier since this inner bag is located in the cylindrically configured storage container and hence double protection of the liquid contained within the inner bag is ensured. Such a storage container consequently has greater impermeability than the storage containers known from the state of the art.

The inner bag of the storage container can have a balloon-like configuration. A balloon-like configuration can be produced for example by a foil bag which is crumpled and squeezed during emptying. An inner bag in the form of an inflatable bag, comparable to an air balloon, is also possible. For an embodiment, the material thickness of the inner bag is preferably in the range of 0.01 to 0.2 mm. This embodiment enables a virtually one hundred per cent spatial use of the storage container which comprises different cylindrical embodiments. There are included herein for example also cylinders with an oval base area.

Furthermore, the inner bag can be formed by bellows which are collapsible in the axial direction. Bellows of this type are distinguished in that the inner bag has at least one circumferential fold which represents a prescribed position at which the folded bag is collapsed during the emptying process. In this respect, a coordinated and ordered emptying of the bag is made possible so that, in comparison with balloon-like inner bags which are not pre-folded, extensive emptying is possible. The bellows which are collapsible in the axial direction preferably have a contact device which is in contact with the inner wall of the storage container on at least one fold and/or on the bellows. As a result of this embodiment of the invention, it is achieved consequently that stabilisation of the bellows relative to the wall occurs so that safe emptying even of viscous products or 'awkward' products with high density is possible. It has in fact been shown that when viscous products are contained in the bellows, the bellows do not retain sufficient stability so that, during emptying, problems can then occur. Because of this preferred embodiment of the bellows with the contact device, this can be avoided.

The contact device can thereby be configured as an integral component of the bellows or as an additional separate component. In the case of the first-mentioned embodiment, the contact device then comprises the same material as the bellows and can even be configured jointly directly during production of the bellows. In the second embodiment, it is provided that a contact device is present as a separate component and this separate component is then connected to the tip of the fold. The tip thereby preferably has a corresponding device (e.g. groove) which receives the ring. The device is thereby configured such that only the ring touches the inner surface of the container. In the simplest case, this can be produced for example by an elastic rubber ring.

The invention can thereby comprises embodiments in which the contact device is disposed both on a fold, on a plurality of folds or on all folds. The number of contact devices on the individual folds is based on the respective application case. The invention can also include embodiments in which the contact device is configured on the bellows base. Likewise, the possibility is jointly included that the contact device is disposed on the bellows base and on one or a plurality or all folds. With respect to the material, basically all materials can be used for formation of the contact device, as are also used for the production of bellows. The materials of the bellows are described subsequently in even more detail.

A further embodiment of the present invention then proposes also that a spring is disposed for additional assistance of the movement of the bellows, this spring being disposed either in the intermediate space between the inner wall of the storage container and the outside of the bellows and/or, on the other hand, the spring being provided in the interior of the bag, and in fact between the connection region and the base of the bellows. A particularly preferred variant of the configuration of the tension spring provides that the spring is a spiral spring which is incorporated circumferentially in the folds of the bellows. In this embodiment, the fold of the bellows also has a spiral configuration. The tension spring is thereby covered entirely or partially by the material of the bellows. In this embodiment, it is particularly advantageous that, when emptying the bellows, a quasi coherent contraction movement of the bellows and of the tension spring takes place, which leads to an exceptionally advantageous mechanical support of the bellows. Hence exceptionally thin-walled bellows can be used without these becoming entangled or blocked during the emptying process so that the mode of operation of the storage container is exceptionally reliable.

The bellows preferably have a bellows base on the underside thereof orientated towards the base of the storage container, said bellows base not being configured to form a seal relative to the inside of the storage container. It can be consequently ensured that a pressure equalisation is made possible in the intermediate space between the bellows and storage container and also below the bellows base and the base of the storage container.

In a further variant, the bellows have a bellows base on the underside thereof orientated towards the base of the container, said bellows base being configured as a drag piston and being mounted to slide in the interior of the storage container, the drag piston having at least one air supply line for pressure equalisation. If another contact device is disposed on the drag piston, e.g., on the bellows base, this also preferably has an air supply line which enables an air supply through the bellows base into the interior of the bellows.

Furthermore, at least one further pressure equalisation device can be disposed in the connection region of the storage container. It can also consequently be ensured that no excess pressure is formed in the intermediate space, e.g. between bellows and storage container, which excess pressure would impede the functional capacity of the storage container or the spraying process. Likewise, it can consequently be ensured that, even in the intermediate space between at least two adjacent contact devices or between contact device and bellows base/base or connection region, no excess pressure is formed.

The material thickness of the bellows is preferably in the range of 0.1 to 1 mm, preferably 0.1 to 0.5 mm. As a result, optimum stability of the bellows and excellent impermeability can be ensured. The bellows can have a plurality of folds which are produced by a pre-fold in the material. The bellows are folded at the pre-fold. This enables for example an accordion-like folding of the bellows. This construction enables complete removal of the liquid. As a result of the fact that the bellows can be configured to be very thin with respect to material thickness (e.g. 0.1 to 0.25 mm material thickness), material is saved.

The material of the inner bag, preferably of the bellows, is selected preferably from the group comprising thermoplastic, elastomer, silicone, thermoplastic elastomer and mixtures thereof, e.g. low density polyethylene as thermoplastic. The material should have authorisation which is suitable for the purpose of use, e.g., be permissible in the medical or foodstuffs field. For example also Santoprene® is conceivable here.

Thermoplastic elastomers are plastic materials which behave comparably to standard elastomers at room temperature but can be deformed plastically with heat supply and hence display thermoplastic behaviour. The following groups are differentiated:

- thermoplastic elastomers based on olefin, predominantly PP/EPDM, e.g. Santoprene® (AES/Monsanto),
- crosslinked thermoplastic elastomers based on olefin, predominantly PP/EPDM, e.g. Sarlink® (DSM), Forprene® (SoFter),
- thermoplastic elastomers based on urethane, e.g. Desmopan®, Texin®, Utechllan (Bayer),
- thermoplastic copolyesters, e.g. Hytrel® (DuPont),
- styrene block copolymers (SBS, SEBS, SEPS, SEEPS and MBS), e.g. Septon® (Kuraray) or Thermoplast® K (Kraiburg TPE),
- Thermoplastic copolyamides, e.g. PEBA.

The inner surfaces of the cylindrical storage container can have a friction-reducing coating in one embodiment. It can consequently be ensured that for example the drag piston can slide optimally within the storage container because of low adhesion or friction. Possibly, also the outside of the drag piston and/or of the contact device can have a friction-reducing coating. As a result, the above-described effect is improved additionally. The friction-reducing coating contains or comprises preferably polyethylene, polytetrafluoroethylene, polyetherketone, polyamide imide, poly(organo)siloxane, graphite, glycerine.

Furthermore, the connection region of the storage container can be formed by a lock-in, lock-on or screw connection. As a function of the materials which are used, the region for connecting or fixing the metering device on the storage container is configured here optimally.

In a preferred embodiment of the storage container, the base can be configured in one piece with the cylindrical container. This enables simple and economical production of the container. Furthermore, a particularly good seal can thus be ensured since no weld seams are present in this variant.

Alternatively or additionally thereto the base can be connected securely to the cylindrical container, which is effected for example by clamping or screwing.

The base of the storage container can have at least one opening and/or at least one filter matrix. The filter matrix hereby has properties, such as air permeability and also bacterial and spore impermeability. Hence complete freedom from germs can be ensured. Furthermore, as a result of the opening or the filter matrix, it can be ensured that no low or excess pressure can be built up in the intermediate space between bellows and storage container and also the surroundings, which pressure could restrict the functional capacity of the device.

The filter matrix is preferably an activated carbon filter, a nylon membrane or a polyvinylidene fluoride membrane. Activated carbon can adsorb all materials, as a result of which the interior of the storage container is protected. The activated carbon filter can also be integrated in the manner of a sandwich between two membranes.

Furthermore, a pressure spring can be provided between the base of the storage container and the bellows base or between the base and the drag piston. This improves in addition the capacity for the collapsible inner bag to be emptied, in particular in the case of viscous products.

Furthermore, a support device for the bellows can be provided on the open side of the storage container in the connection region. This support device is configured such that it serves as support surface for the collapsible bellows. The dimensioning is correspondingly designed.

The storage container preferably has a cylindrical configuration. The storage container can be formed from glass, metal, in particular aluminium or tinned sheet iron, plastic material, preferably polypropylene or polyethylene. In particular the stability of the storage container and its impermeability can be ensured by these materials since, as a function of the product to be sprayed, the material is chosen which is best compatible or suitable for the provided purpose of use.

The use of the above-described storage container is effected preferably for storing medical products, pharmaceutical products, cosmetic products, cleaning agents, chemicals, food supplements or liquid spices. The storage container can serve for storing eye drops and formulations for nasal sprays, preferably without preservatives. The storage container can be used for storing preparations which contain vitamins, mineral materials, enzymes, co-enzymes, plant extracts, bacteria, yeasts, as individual substance or a mixture comprising a plurality of these substances, preferably without preservatives.

It is hereby conceivable that, with a correspondingly configured connection region, the collapsible inner bag or bellows is exchanged after complete emptying and a new filled inner bag is inserted into the storage container. Also refilling of the inner bag, in particular in the sphere of provisions, foodstuffs or cosmetics, is conceivable. Furthermore, this takes into account also environmental protection considerations since a lower consumption of plastic materials or material is associated herewith.

With reference to the subsequent FIGS. 1 to 9, the subject according to the application is intended to be explained in more detail without restricting the latter to the special embodiments shown here.

FIG. 1*a*) shows a storage container according to an embodiment of the invention from below without a base.

Figure 1B:
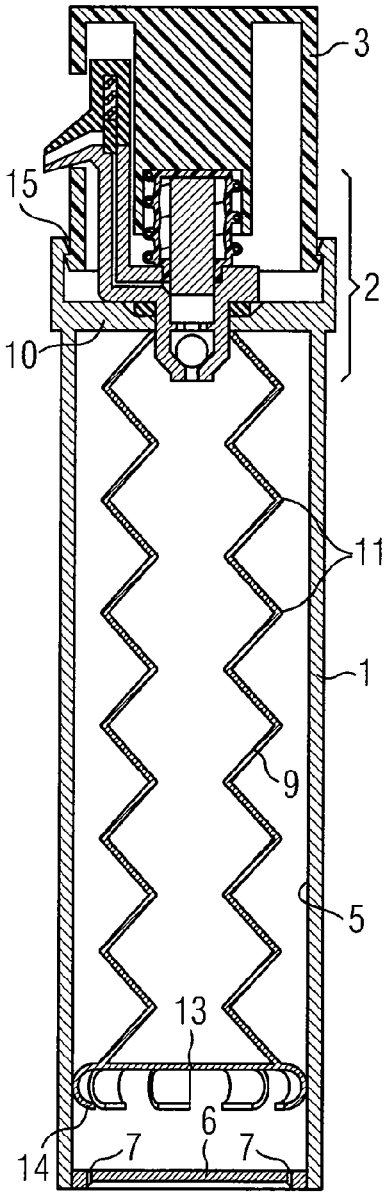

FIG. 1*b*) shows a spraying device in a longitudinal section, the bellows according to an embodiment of the invention having stabilisation of the base due to so-called fingers and being partially filled.

Figure 1C:
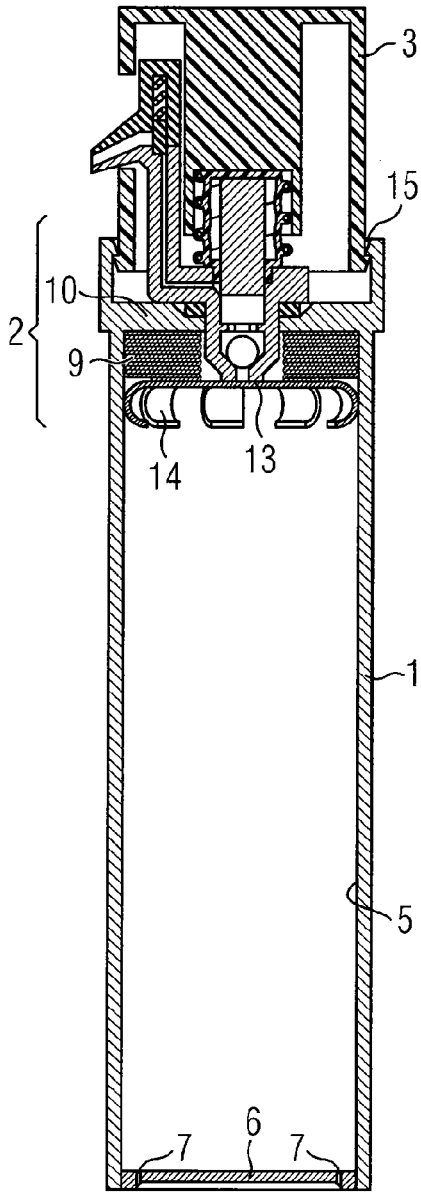

FIG. 1*c*) shows the longitudinal section through the embodiment represented in FIG. 1*b*), the bellows here being completely emptied.

Figure 2A:
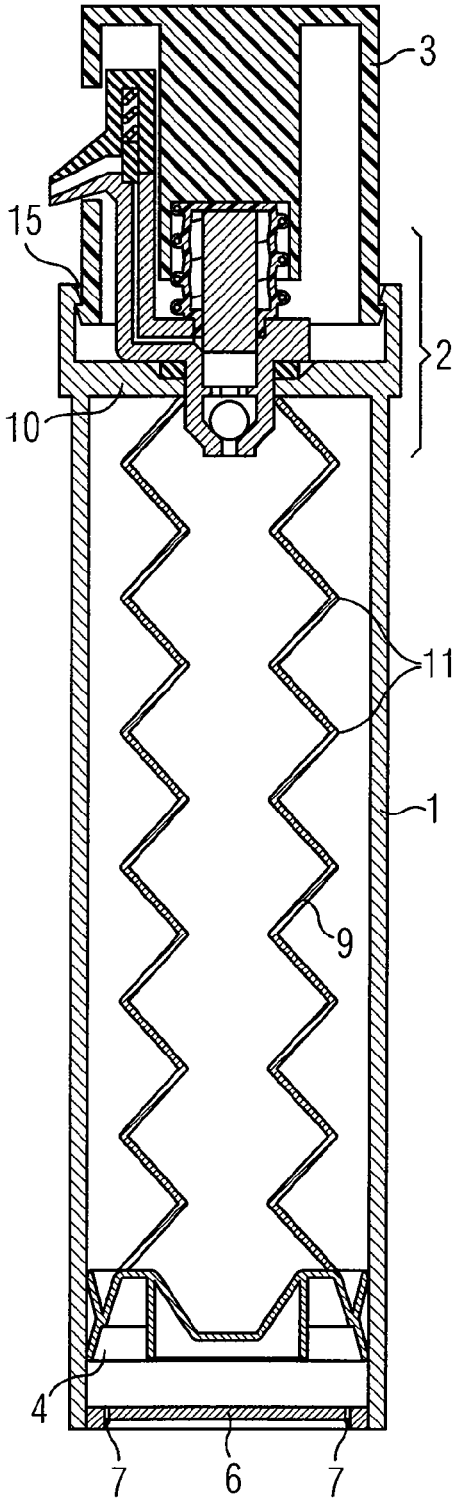

FIG. 2*a*) shows a longitudinal section through a spraying device, the base of the bellows being connected to a drag piston.

Figure 2B:
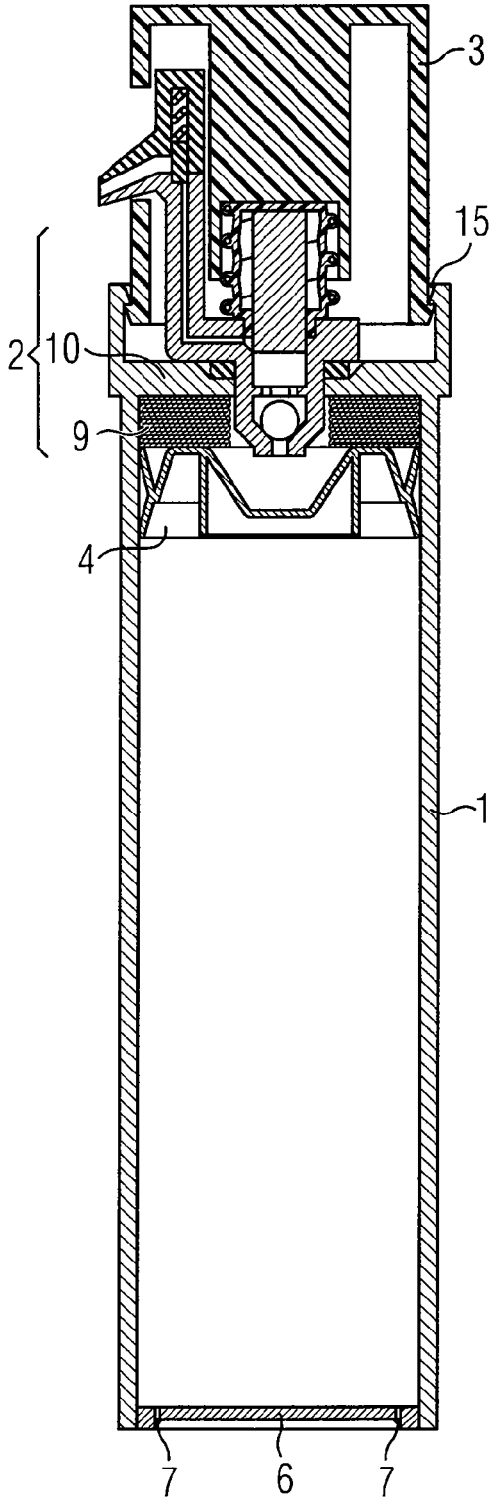

FIG. 2*b*) shows the embodiment variant of FIG. 2*a*) in a completely emptied form.

Figure 3A:
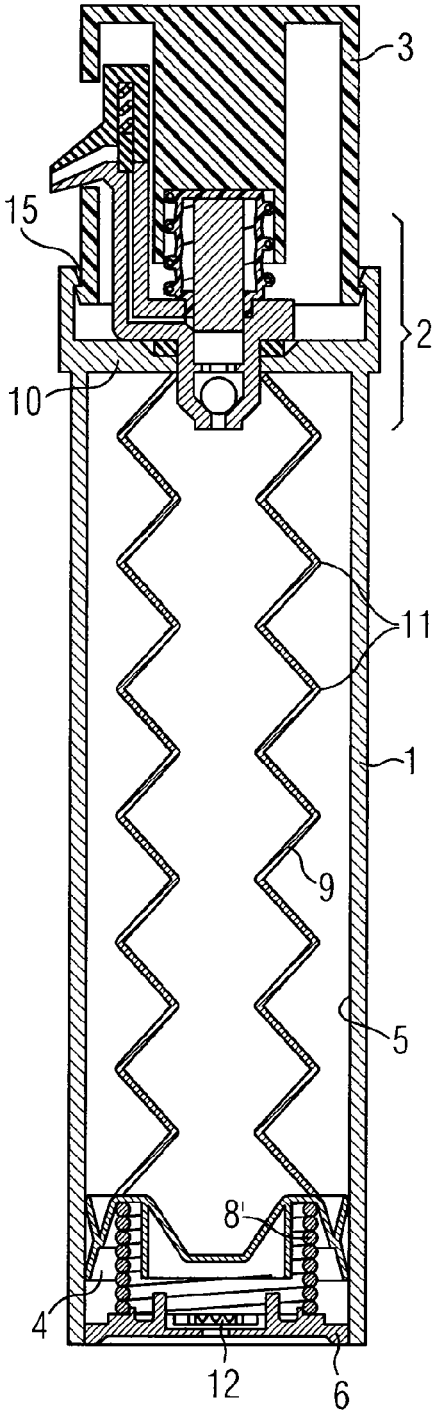

FIG. 3*a*) shows a longitudinal section through a spraying device, as represented already in FIG. 2*a*), in addition a pressure spring and a filter matrix being disposed here however in the base of the storage container.

Figure 3B:
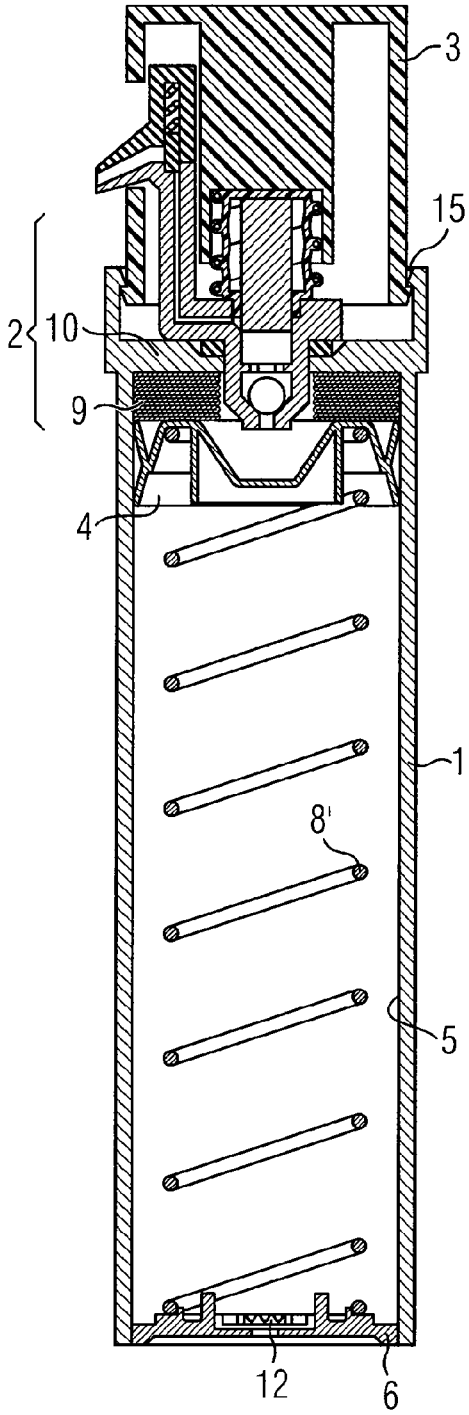

FIG. 3*b*) shows a longitudinal section through the spraying device, as shown in FIG. 3*a*), but in the completely emptied state.

Figure 4:
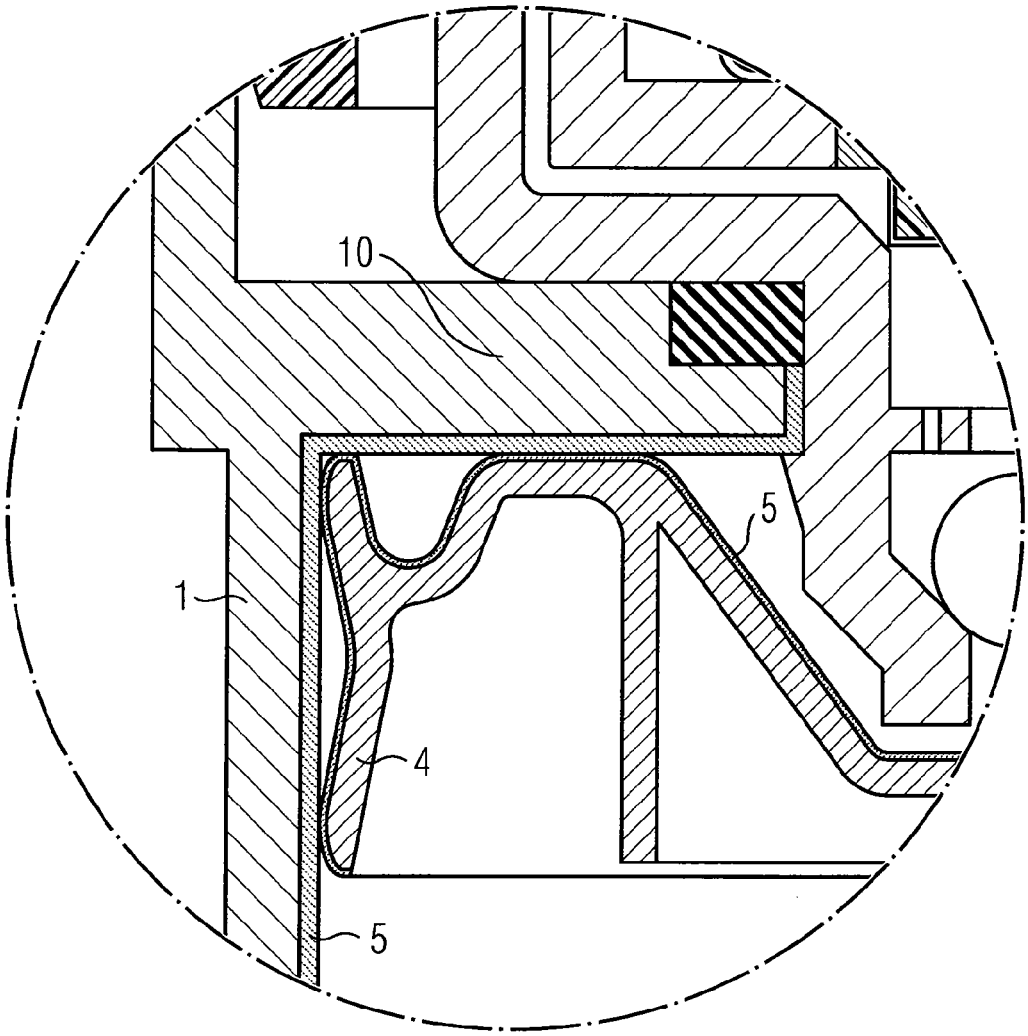

FIG. 4 shows an enlarged section of the connection region of the spraying device, the inner wall and drag piston having a friction-reducing coating.

Figure 5A:
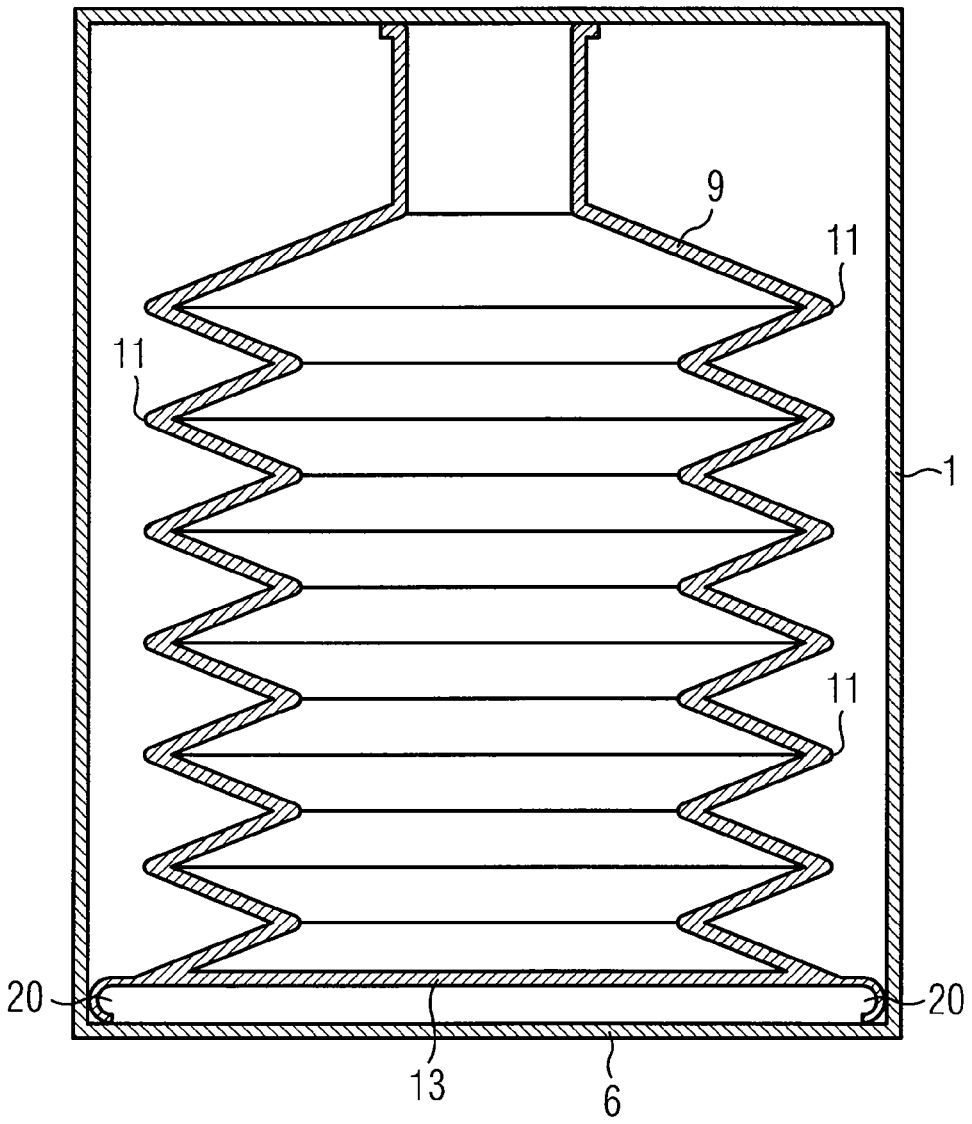

In FIGS. 5*a*) to 5*c*), embodiments of the storage container with contact devices are represented.

Figure 6A:
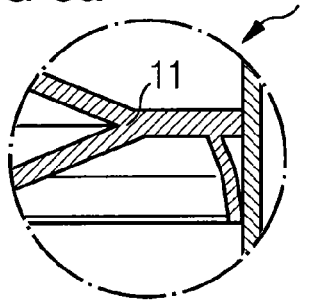

FIGS. 6*a*) to 6*g*) show different embodiments of the contact device.

Figure 7:
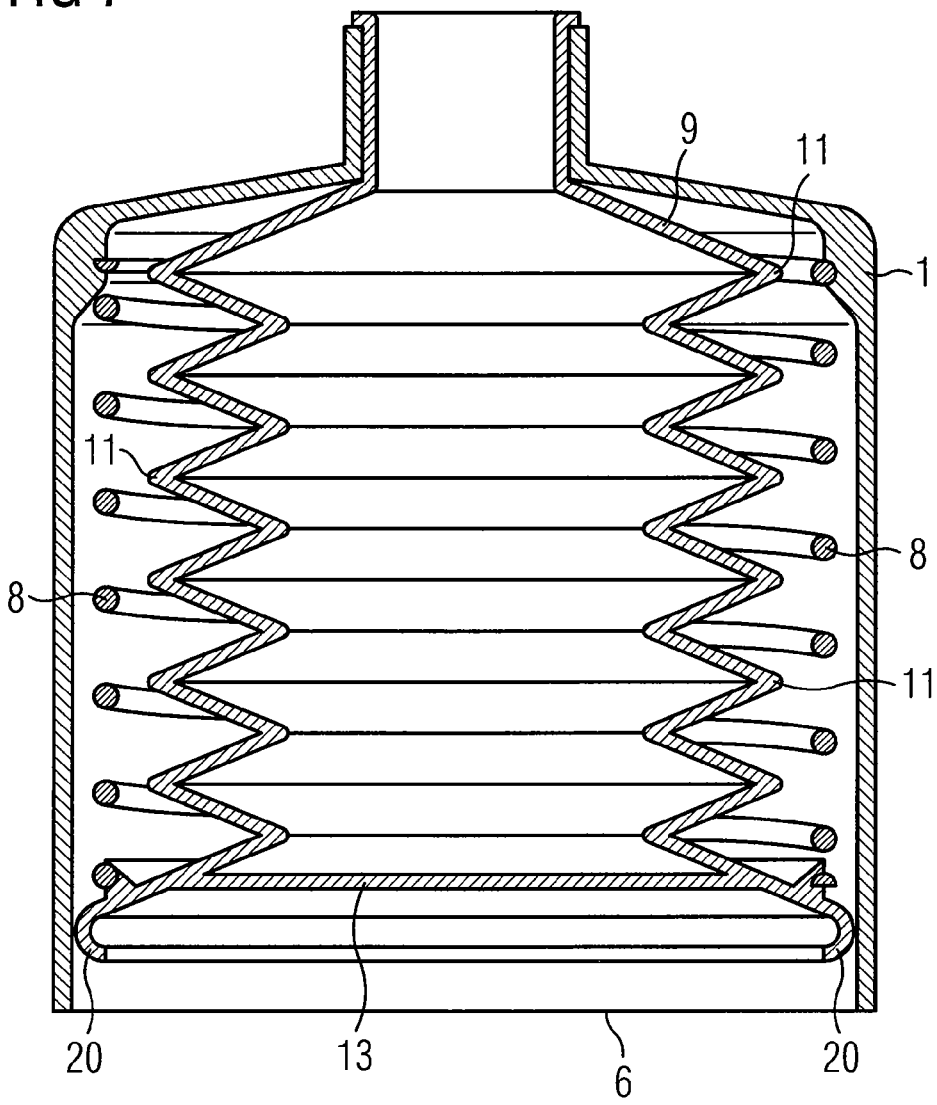
Figure 8:
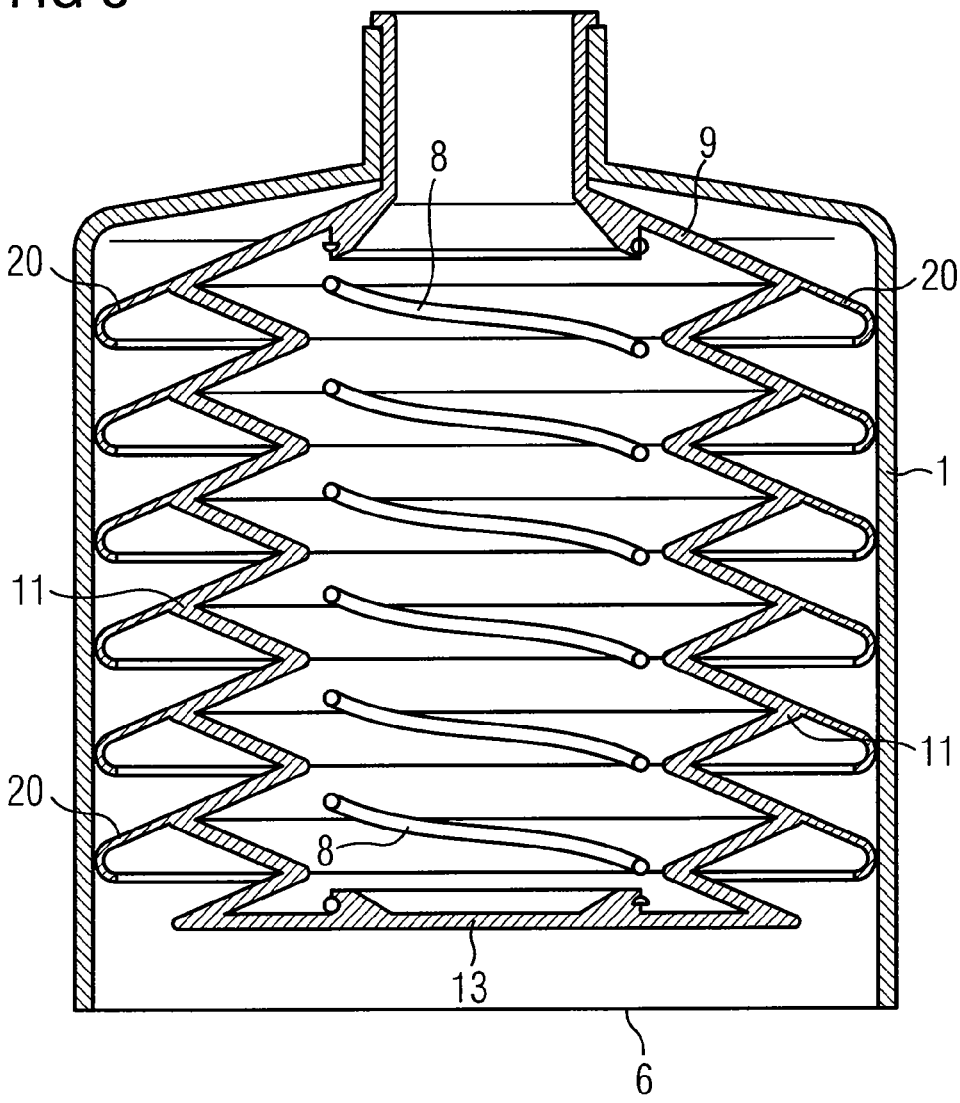
Figure 9:
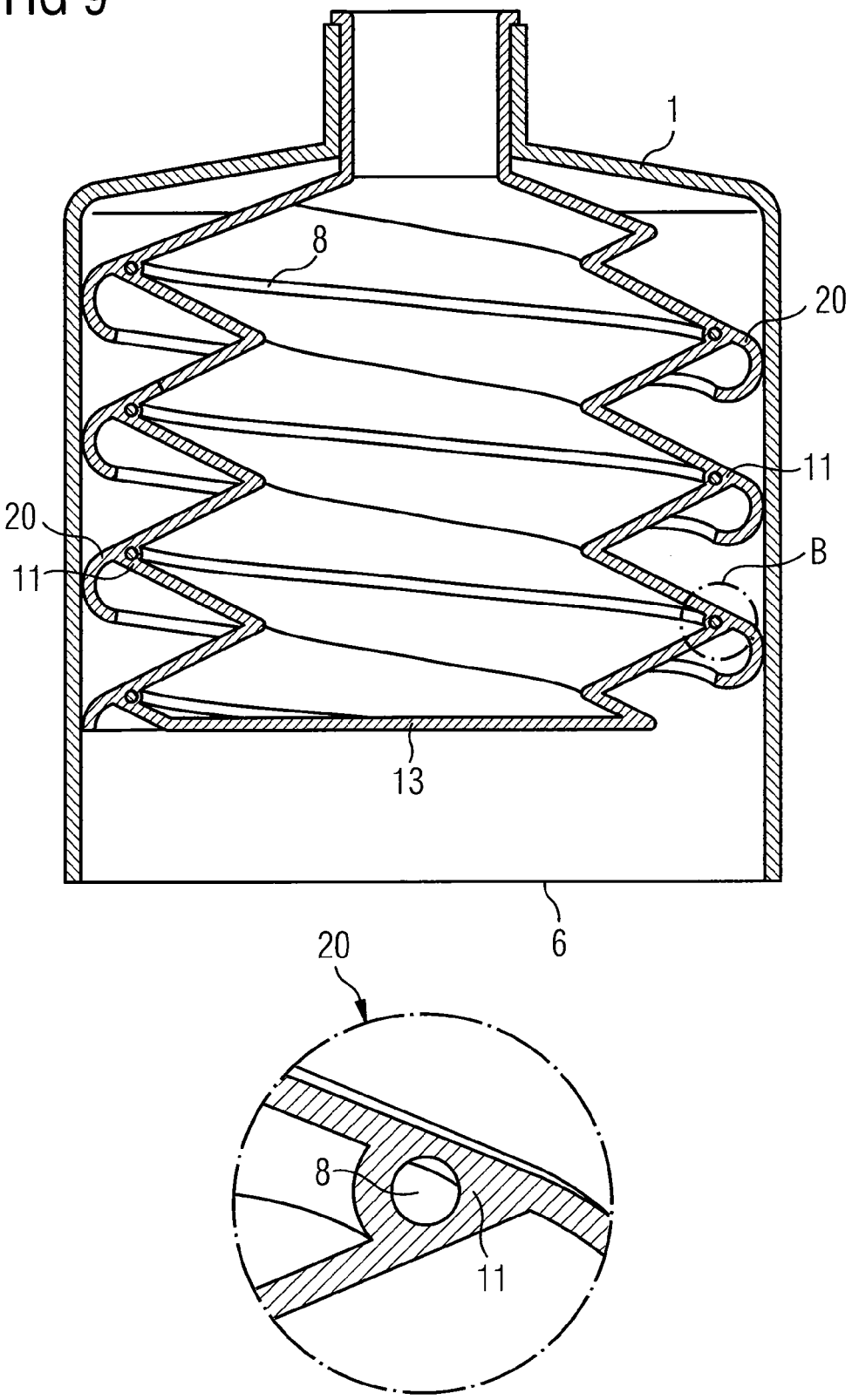

FIGS. 7 to 9 show embodiments of the storage container which has both contact devices and return springs.

In FIG. 1*a*), a view from below of a cylindrical storage container 1 according to an embodiment of the invention without a base is represented. Fingers 14 are hereby disposed on the bellows base 13 of the bellows 9. This is situated within the storage container 1.

FIG. 1*b*) shows the longitudinal section through the spraying device, the pump head 3 being fitted via the connection region 2 to the storage container 1 according to an embodiment of the invention. Because of the locking connection 15 in the connection region 2, the storage container 1 according to an embodiment of the invention is connected to the metering device 3, as is shown here by way of example for various embodiments. At the region of the storage container 1 orientated towards the metering device 3, the support device 10 for the bellows 9 is disposed.

The bellows 9 have folds 11 which enable optimum foldability of the bellows 9. The folding 11 of the bellows 9 thereby has a symmetrical configuration, e.g., the folds, in the case of cylindrical bellows 9, represent concentrically circumferential bends, by means of which the bellows 9 are collapsed during the emptying process. Alternatively or additionally hereto also a spirally circumferential folding is however possible (not represented), which could also be termed spirally circumferential endless fold. The described variants of the folding can be also applied to the subsequently represented Figures. The bellows base 13 orientated towards the base 6 of the storage container 1 has fingers 14, recesses through which the air can circulate unimpeded being disposed between the fingers 14. The inside of the storage container 1 can have a friction-reducing coating 5. In order that no low or excess pressure can build up between storage container 1 and bellows 9, an external air supply is possible through the openings 7 on the base 6 of the storage container 1. In this Figure, the bellows 9 are almost completely filled with liquid.

FIG. 1*c*) shows the longitudinal section through the embodiment which is shown in FIG. 1*b*), the bellows 9 being completely emptied here and hence abutting directly against the support device 10 which is located in the connection region 2.

FIG. 2*a*) shows a longitudinal section through a spraying device, the bellows 13 being configured here as drag piston 4 which has openings for an air supply. The bellows 9 which are disposed within the storage container 1 have folds 11. The base 6 of the storage container 1 has openings 7 for ventilation. In the connection region 2 between the metering device 3 and the storage container 1, the support device 10 is situated.

In FIG. 2*b*), a longitudinal section through a spraying device, as represented in FIG. 2*a*), is shown in emptied form. The bellows 9 are located here completely folded against the support device 10 which is situated in the connection region 2 between the metering device 3 and the storage container 1. The base of the storage container 1 has two openings 7 through which air can pass into the storage container 1, which ensures a pressure equalisation both within the storage container 1 and a pressure equalisation with the environment.

FIG. 3*a*) shows a longitudinal section through a spraying device which has the maximum content, the bellows 9 being connected to a drag piston 4. In addition a pressure spring 8' is disposed here between the drag piston 4 and the base 6 of the cylindrical storage container 1. The base 6 of the storage container 1 has a filter matrix 12 which ensures passage of air. The inside of the storage container 1 can be coated with a friction-reducing coating 5. The bellows 9 have folds 11 which prescribe an accordion-like folding of the bellows 9. In the connection region 2 between the metering device 3 and the storage container 1, the support device 10 for the bellows 9 is disposed.

In FIG. 3*b*), a longitudinal section through the spraying device represented in FIG. 3*a*) is shown, the bellows 9 being completely emptied here and located on the support device 10. The support device 10 is situated in the connection region 2 between the storage container 1 and the metering device 3. The bellows 9 are connected to the drag piston 4. The pressure spring 8' is now relaxed as far as possible. The base 6 of the storage container 1 has a filter matrix 12 which enables the air exchange with the environment. For a movement of the drag piston 4 which is as free of friction as possible, the inner region of the storage container 1 is provided with a friction-reducing coating 5.

FIG. 4 shows an enlarged section of the connection region 2 between the cylindrical storage container 1 according to an embodiment of the invention and the metering device 3. The drag piston 4 is hereby located directly on the support device 10. Both the drag piston 4 and the storage container 1 have a friction-reducing coating 5.

In FIGS. 5*a*) to 5*c*), embodiments of the storage container according to an embodiment of the present invention are represented, which embodiments have one or more contact devices 20. The contact device 20 can thereby ensure, as a function of the direction of movement, for example reduced friction in the emptying direction, but can ensure a strong braking effect of the bellows or of the drag piston in the opposite direction. In this respect, the contact device can be configured as a recoil protection contact device. The contact devices 20 thereby effect increased friction and/or static friction between the braking element 20 and the wall of the storage container 1. The contact devices are thereby dimensioned such that they form a seal in a form fit with the wall of the cylindrical storage container.

In FIG. 5*a*), a storage container according to an embodiment of the invention which has a contact device 20 fitted on the bellows base 13 is represented. The contact device 20 is thereby connected over the entire surface to the bellows base 13 and forms a seal in a form fit circumferentially with the wall of the cylindrical storage container 1.

The contact device 20 is thereby disposed directly on the bellows base 13 and is moulded on in the form of an open element in the direction of the bellows base 13.

Figure 5B:
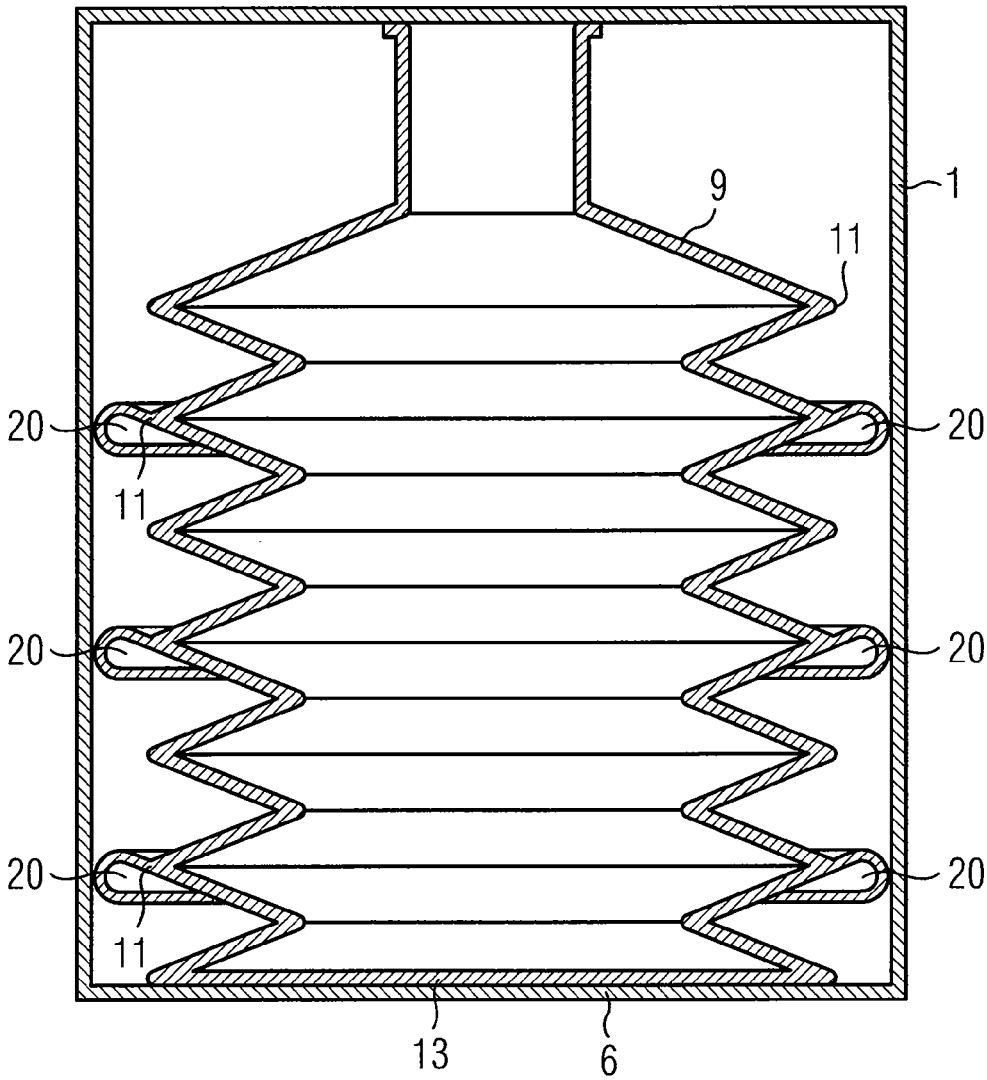

In FIG. 5*b*), another embodiment is represented, the contact devices being disposed on some of the externally situated folds 11 which are orientated towards the wall of the storage container 1.

In the case of the example, contact devices are disposed here on each second fold 11. The contact device 20 is configured as a loop shape and is moulded in one piece onto the material of the bellows (9).

Figure 5C:
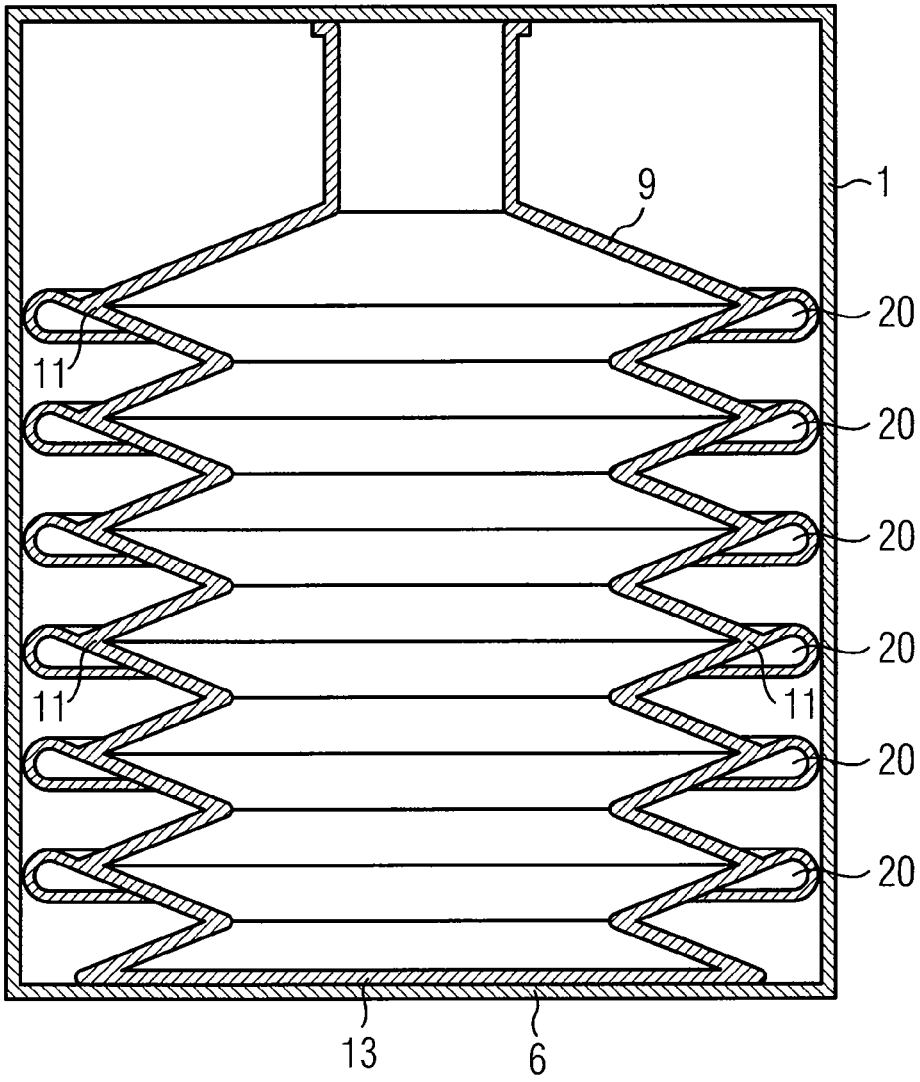

In FIG. 5*c*), a further embodiment is shown, each of the folds 11 orientated towards the walls of the cylindrical storage container 1 having a contact device 20.

Figure 6B:
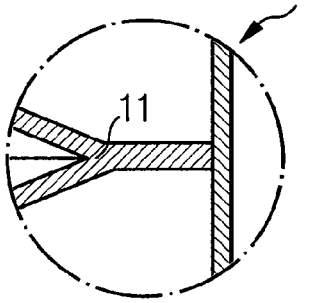
Figure 6C:
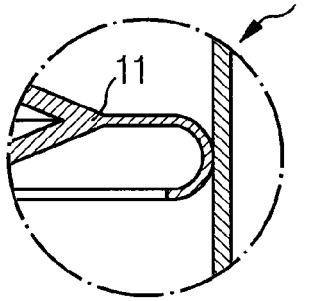
Figure 6D:
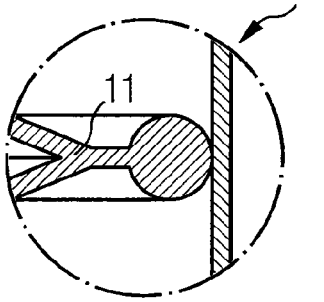
Figure 6E:
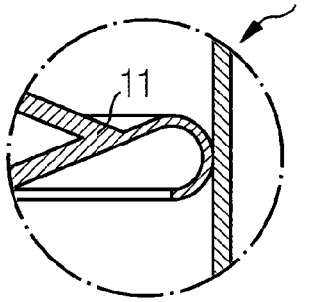
Figure 6F:
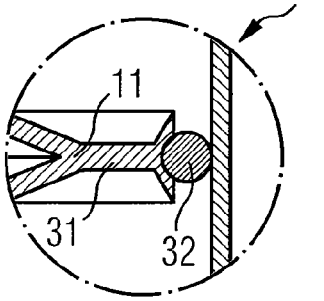
Figure 6G:
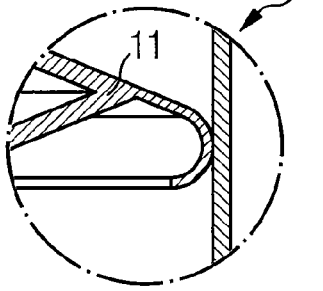

In FIGS. 6*a*) to 6*g*), various preferred embodiments of the contact device are represented. As emerges from the sequence of FIGS. 6*a*) to 6*g*), the contact device which is connected here in the case of the example always in one piece to the fold 11 of the bellows can be configured in different geometrical shapes. The choice of geometrical shape is based essentially on whether the contact device is intended to exert a sliding function or a braking function. Thus the contact device can be configured as a sphere (FIG. 6*d*)) or as a horizontal element (as is represented in FIG. 6*b*). Also embodiments in loop form, as represented in FIGS. 6*e*) and 6*g*), are possible. As also emerges from FIG. 6*f*), the invention can include embodiments in which the contact device is configured in two parts, e.g., in that it comprises, on the one hand, a horizontal extension 31 which is connected in one piece to the tip of the fold 11 and in that also an annular element 32 which is in contact with the inner wall of the storage container 1 is then provided in addition.

With respect to the configuration of the materials, reference is made to the materials of the above-described bellows. The contact devices 20 can of course also be provided in addition with a sliding layer.

FIG. 7 relates to a further preferred embodiment of the storage container according to an embodiment of the invention which has a contact device which is configured according to FIG. 5 and is disposed on the bellows base 13.

Furthermore, the storage container 1 according to FIG. 7 contains a tension spring 8 which assists the emptying process.

FIG. 8 relates to a further embodiment which has a plurality of contact devices 20 on the externally situated folds 11. In addition, a tension spring 8 is situated in the interior of the bellows, e.g., between the connection region 2 and the base 13 of the bellows.

The embodiment according to FIG. 9 relates to an embodiment of the storage container, a circumferential fold 11 being adapted to the geometry of the tension spring 8. Hence the one circumferential fold 11 has a circumferential contact device 20. The tension spring 8 thereby extends through the fold 11. The tension spring 8 can be incorporated for example during production of the bellows 9, e.g. be embedded.

What is claimed is:

1. A storage container for liquids or for viscous or atomizable products, which can be connected to a metering device, wherein the storage container comprises:

a cylindrical configuration including a base with a pressure equalization device and an oppositely situated open side, the open side comprising a connection region; and an inner bag that is collapsible by suction force and is disposed in the storage container, wherein the inner bag comprises a balloon-like configuration or bellows that are collapsible in an axial direction of the cylindrically configured storage container; and a contact device, disposed on and attached to a movable outer circumferential portion of the inner bag, wherein the contact device is in movable contact with a circumferential inner wall of the storage container.

2. The storage container according to claim 1, wherein the inner bag comprises bellows that are collapsible in the axial direction of the cylindrically configured storage container.

3. The storage container according to claim 2, wherein the contact device that is in contact with the inner wall of the storage container is disposed on at least one fold of the bellows.

4. The storage container according to claim 3, wherein the contact device is configured in one piece with the at least one fold.

5. The storage container according to claim 3, wherein the contact device is configured as a separate component from the at least one fold and is connected to the at least one fold.

6. The storage container according to claim 5, wherein the contact device includes an elastic ring.

7. The storage container according to claim 2, wherein a tension spring is provided between the inner wall of the storage container and the outside of the bellows.

8. The storage container according to claim 2, wherein a tension spring is disposed in the interior of the bellows between the connection region and a bellows base.

9. The storage container according to claim 8, wherein the tension spring is a spiral spring which is fitted circumferentially into the at least one fold.

10. The storage container according to claim 2, wherein the bellows, on the underside thereof orientated towards the base of the storage container, have a bellows base, which is unsealed relative to the inside of the storage container.

11. The storage container according to claim 2, wherein the bellows, on the underside thereof orientated towards the base of the storage container, have a bellows base, which is configured as a drag piston and is mounted to slide in the interior of the storage container, the drag piston having at least one air supply line for pressure equalization.

12. The storage container according to claim 2, wherein a pressure spring is provided between the base of the cylindrically configured storage container and a base of the bellows, or is provided between the base of the cylindrically configured storage container and a drag piston.

13. The storage container according to claim 2, wherein a support device for the bellows is provided on the open side of the cylindrically configured storage container in the connection region.

14. The storage container according to claim 1, wherein the contact device is configured as a braking device.

15. The storage container according to claim 1, wherein at least one further pressure equalization device is disposed in the connection region of the storage container.

16. The storage container according to claim 1, wherein the base of the storage container has at least one opening and/or filter matrix.

17. The storage container according to claim 1, comprising a friction-reducing coating on or in contact with an inner surface of the cylindrical storage container.

18. A method comprising:

providing a storage container for liquids or for viscous or atomizable products, which can be connected to a metering device, wherein the storage container comprises a cylindrical configuration including a base with a pressure equalization device and an oppositely situated open side, the open side comprising a connection region, and an inner bag that is collapsible by suction force and is disposed in the storage container, wherein the inner bag comprises a balloon-like configuration or bellows that are collapsible in an axial direction of the cylindrically configured storage container, and wherein a contact device is disposed on and attached to a movable outer circumferential portion of the inner bag, wherein the contact device is in movable contact with a circumferential inner wall of the storage container; and using the storage container for storing medical products, pharmaceutical products, cosmetic products, cleaning agents, chemicals, food supplements, or liquid spices.

19. The method according to claim 18, comprising using the storage container for storing, without preservatives, at least one of eye drops or one or more formulations for nasal sprays.

20. The method of claim 18, comprising using the storage container for storing, without preservatives, a preparation that contains at least one or a mixture of vitamins, mineral materials, enzymes, co-enzymes, plant extracts, bacteria, or yeasts.

* * * * *